United States Patent [19]

Hayashi et al.

[11] Patent Number: 4,599,275

[45] Date of Patent: Jul. 8, 1986

[54] METAL-DEPOSITED PAPER AND METHOD FOR PRODUCTION THEREOF

[75] Inventors: Akira Hayashi, Urawa; Yutaka Hirota, Mitaka; Mitsuhiro Tanaka, Ohtake, all of Japan

[73] Assignee: Mitsui Petrochemical Industries, Ltd., Tokyo, Japan

[21] Appl. No.: 619,410

[22] Filed: Jun. 13, 1984

Related U.S. Application Data

[63] Continuation of Ser. No. 162,896, Jun. 25, 1980, abandoned.

[30] Foreign Application Priority Data

Jun. 29, 1979 [JP] Japan ..... 54-81298
Feb. 25, 1980 [JP] Japan ..... 55-22578

[51] Int. Cl.[4] ..... B32B 15/08

[52] U.S. Cl. ..... 428/461; 156/327; 156/334; 229/3.5 MF; 426/126; 427/250; 427/404

[58] Field of Search ..... 156/327, 334; 426/126; 427/250, 404; 428/461; 525/919; 260/DIG. 31, 29.6 R, 29.6 H, 29.6 WB; 229/3.5 MF

[56] References Cited

U.S. PATENT DOCUMENTS

| | | | |
|---|---|---|---|
| 2,838,437 | 6/1958 | Busse et al. | 156/334 |
| 2,970,129 | 1/1961 | Rugg et al. | 525/265 |
| 3,250,638 | 5/1966 | Lassiter | 428/461 |
| 3,264,272 | 8/1966 | Rees | 156/332 |
| 3,365,409 | 1/1968 | Lanthier | 156/327 |
| 3,484,338 | 12/1969 | Britton et al. | 524/428 |
| 3,730,752 | 5/1973 | Gorza et al. | 428/457 |
| 3,764,458 | 10/1973 | Ziegel | 156/334 |

FOREIGN PATENT DOCUMENTS

| | | | |
|---|---|---|---|
| 2129358 | 12/1971 | Fed. Rep. of Germany | 428/461 |
| 1367662 | 9/1974 | United Kingdom | 428/461 |

*Primary Examiner*—John J. Gallagher
*Attorney, Agent, or Firm*—Sherman & Shalloway

[57] ABSTRACT

A metal-deposited paper comprising a paper substrate, a thin continuous coating of a film-forming resin having good adhesion to metals on at least one surface thereof, and a metal film deposited on the resin coating. The aforesaid paper can be produced by applying a thin continuous coating of a film-forming resin having good adhesion to metals on at least one surface of a paper substrate, and then vacuum-depositing a metal on the surface of the resin coating.

8 Claims, No Drawings

METAL-DEPOSITED PAPER AND METHOD FOR PRODUCTION THEREOF

This application is a continuation, of application Ser. No. 162,896, filed June 25, 1980, now abandoned.

This invention relates to a metal-deposited paper and to a method for production thereof. More specifically, this invention relates to a metal-deposited paper, especially an aluminum-deposited paper, which substantially retains the inherent properties of paper and low air- and moisture-permeability and in which a smooth metal-deposited layer having a superior metallic luster is firmly bonded to the substrate paper, and to a method for production thereof.

Metal-incorporated paper obtained by bonding an aluminum foil to paper, because of its decorative appearance and low air- and moisture-permeability, is widely used in articles desired to be protected from moisture absorption or dissipation of volatile components, for example as packaging material for confectionery, tobaccos, medicines, etc. or as labels. A composite obtained by bonding a zinc foil to paper is used as a paper condenser.

Such a metal-incorporated paper, however, has the defect that since the metal foil can be reduced in thickness only to a limited extent and is liable to cause pinholes, the cost of production rises, and that the properties of the metal foil appear predominantly to cause a loss of the characteristics of paper.

As one means for avoiding such a defect, it may be possible to vacuum-deposit aluminum or zinc on one or both surfaces of paper. A product obtained by vacuum-depositing such a metal on untreated paper still predominantly has the properties of paper itself and exhibits high air-permeability and no moisture proofness, and moreover, the uneven surface of the paper is reproduced as such on the metal-deposited layer which is extremely thin. Accordingly, the product has no luster and there is no significance in coating paper with metal. The paper condenser mentioned above is required to have a smooth surface of uniform thickness and be free from pinholes, but the aforesaid zinc depositing method cannot meet this requirement.

It may also be possible, as in a conventional practice, to vacuum-deposit a metal such as aluminum or zinc on a plastic film, and bond the metal-deposited plastic film to paper. For this purpose, the plastic film should have self-supporting property and be considerably thick. A sheet obtained by bonding such a plastic film to paper scarcely retains the inherent characteristics of paper, such as bursting property and bendability, and strongly shows the properties of the plastic film. Hence, there is no significance in bonding paper to the metal-deposited plastic film.

Likewise, it may also be possible to laminate a plastic film to paper, and deposit a metal on the surface of the plastic film in this laminate. In this case, the thickness of the plastic film can be reduced to a greater extent than in the case of using the self-supporting plastic film. However, the thickness of the plastic film is still fairly large, and the inherent properties of paper tend to be lost. Furthermore, such a method would be uneconomical since a laminated paper roll of a large diameter must be placed into a batch-operation vacuum deposition device.

It is an object of this invention to provide a metal-deposited paper which substantially retains the inherent properties of paper, such as bursting property, bendability (flexibility), strength, elongation and hardness, and in which a smooth metal-deposited layer having a superior metallic luster is firmly bonded to the paper substrate.

Another object of this invention is to provide a metal-deposited paper which substantially retains the inherent properties of paper and has low air- and moisture-permeability and in which a smooth metal-deposited layer having a superior metallic luster is firmly bonded to the paper substrate.

Still another object of this invention is to provide such a metal-deposited paper in which the properties of the deposited metal surface are not impaired even when the paper is in the stacked state.

A further object of this invention is to provide a method for producing such a metal-deposited paper.

According to this invention, there is provided a metal-deposited paper, comprising a paper substrate having on at least one surface thereof a thin continuous coating of a film-forming resin having good adhesion to metal, and a metal film deposited on the surface of the resin coating on the paper substrate.

The characteristic feature of the metal-deposited paper provided by the present invention is that a continuous coating of a film-forming resin having good adhesion to metal is provided as an interlayer for levelling the surface of a paper substrate and strengthening adhesion between the paper substrate and a metal-deposited layer, in such a thickness as to cause no substantial loss of the inherent properties of paper.

The "film-forming resin having good adhesion to metal", used in this invention, also includes thermoplastic resins having no polar group such as styrene/butadiene copolymer and polybutadiene. Synthetic thermoplastic resins having at least one polar group such as a carboxyl group, a carboxylate group (i.e., carboxyl in the form of a salt or ester), a halogen atom, an acyloxy group or a nitrile group, particularly those containing a carboxyl group or a carboxylate salt group, have better adhesion to metal, and are therefore preferred.

Specific examples of such a polar group-containing resin are given below.

(1) Carboxy-modified olefinic resins

Resins in this group include copolymers of olefins and $\alpha,\beta$-ethylenically unsaturated carboxylic acids or the derivatives thereof, and grafted copolymers resulting from grafting of $\alpha,\beta$-ethylenically unsaturated carboxylic acids or the derivatives thereof to olefinic polymers.

The olefins are, for example, those having 2 to 12 carbon atoms, such as ethylene, propylene, butene-1, 4-methyl-1-pentene and hexene-1. Examples of the olefinic polymers are polyethylene, polypropylene, polybutene-1, poly-4-methyl-1-pentene, ethylene/propylene copolymer, ethylene/butene-1 copolymer, ethylene/4-methyl-1-pentene copolymer, ethylene/hexene-1 copolymer, propylene/butene-1 copolymer, and 4-methyl-1-pentene/decene-1 copolymer.

Examples of the $\alpha,\beta$-ethylenically unsaturated carboxylic acids to be copolymerized or graft-copolymerized with these olefins or olefinic polymers include $\alpha,\beta$-ethylenically unsaturated monocarboxylic acids having 3 to 10 carbon atoms such as acrylic acid, methacrylic acid, crotonic acid, isocrotonic acid and 1-undecylenic acid, and $\alpha,\beta$-ethylenically unsaturated dicarboxylic acids having 4 to 20 carbon atoms such as maleic acid, itaconic acid, citraconic acid and 5-norbornene-2,3-dicarboxylic acid. Examples of the derivatives of these unsaturated carboxylic acids are derivatives of carboxylic acids convertible to carboxylic acids by reaction with water, such as acid anhydrides, esters, acid amides and acid imides. These $\alpha,\beta$-ethylenically unsaturated carboxylic acids or their derivatives can be copolymerized in an amount of generally about 5 to about 45% by weight, preferably about 10 to about 20% by weight, in the copolymer or graft copolymer.

If desired, the copolymer or graft copolymer obtained by using the derivatives of the carboxylic acids can be converted to those containing carboxyl groups by hydrolysis. At least some of the free carboxyl groups in the carboxyl-containing copolymer or graft-copolymer may be in the form of salts such as alkali metal salts or alkaline earth metal salts (e.g., potassium, sodium, calcium or zinc salts) or may be ionically crosslinked by these metals.

Typical examples of these carboxy-modified olefinic resins are ethylene/acrylic acid copolymer, ethylene/methyl acrylate/acrylic acid copolymer, ethylene/methacrylic acid copolymer, ethylene/methyl methacrylate/methacrylic acid copolymer, acrylic acid-grafted polyethylene, maleic anhydride-grafted polyethylene, and maleic anhydride-grafted polypropylene.

Of these, ionomer resins and $\alpha,\beta$-ethylenically unsaturated carboxylic acid-grafted polyolefins having an acid value of about 30 to about 150, preferably about 50 to about 130, are especially suitable. A typical ionomer resin is a $Na^+$ or $K^+$ ionically crosslinked product of ethylene/methacrylic acid copolymer having a methacrylic acid unit content of about 5 to 45% by weight, preferably about 10 to about 20% by weight. If the methacrylic acid unit content exceeds 45% by weight, a coated film prepared from the resin has poor water resistance and heat resistance. If it is less than 5% by weight, the self dispersibility of the resin becomes poor. About 30 to 80% of the methacrylic acid units present are neutralized with $Na^+$ or $K^+$. This ionomer resin has self-dispersibility as described hereinbelow, and gives an aqueous dispersion having a small particle size and good storage stability.

(2) Halogen-containing vinyl resins

Resins in this group include vinyl chloride resins such as polyvinyl chloride, and ethylene/vinyl chloride copolymer, vinyldene chloride resins such as polyvinylidene chloride, vinylidene chloride/butadiene/methyl acrylate copolymer and vinylidene chloride/acrylic acid copolymer, and chlorinated polyolefins such as chlorinated polyethylene and chlorinated polypropylene. These resins can be used either singly or in combination with each other. The vinylidene chloride resins are preferred.

(3) Vinyl acetate resins

Resins of this group include polyvinyl acetate, vinyl acetate/ethylene copolymer, vinyl acetate/acrylate ester copolymers, vinyl acetate/dibutyl maleate copolymer, and partially saponified products thereof.

(4) Acrylic resins

These resins include homopolymers or copolymers of acrylic monomers such as acrylic acid, methacrylic acid, or $C_1$–$C_8$ alkyl esters of acrylic or methacrylic acid such as methyl acrylate, methyl methacrylate, ethyl acrylate, butyl acrylate, octyl acrylate and isobutyl methacrylate, and copolymers of a major proportion of these acrylic monomers with a minor poroportion of other comonomers such as styrene, acrylonitrile, vinyl chloride, vinylidene chloride and ethylene. Some examples of copolymers of acrylic monomer and other comonomers are styrene/butyl acrylate/butyl methacrylate copolymer, styrene/methyl methacrylate/butyl methacrylate copolymer and styrene/methyl methacrylate copolymer.

(5) Other polar group-containing resins

Acrylonitrile-butadiene copolymer.

The above-exemplified polar group-containing resins can be used either singly or in combination with each other. Of the above resins, the carboxy-modified olefinic resins are most suitable.

The polar group-containing resins may be used as a mixture with compatible resins having no polar group. For example, the carboxy-modified olefinic resins may be mixed with vinyl acetate resins such as ethylene/vinyl acetate copolymer, its saponification product, or olefinic resins such as polyethylene, polypropylene, poly-1-butene, poly-4-methyl-1-pentene, ethylene/propylene copolymer, ethlene/1-butene copolymer, ethylene/butadiene copolymer, ethylene/propylene/butadiene terpolymer, ethylene/propylene/dicyclopentadiene terpolymer, ethylene/propylene/ethylidenenorbornene terpolymer, propylene/1-butene copolymer, propylene/butadiene copolymer, and mixtures of these polymers. When the polar group-containing resin is used in admixture with a resin containing no polar group, such as the aforesaid olefinic resins, the proportion of the polar group-free resin should be limited to the one which does not markedly reduce the adhesion of the resin mixture to metal. Although the mixing proportion is not critical, it is generally desirable that the polar group-free resin be used in an amount of up to 50% by weight, preferably up to 40% by weight, based on the total weight of these two resins.

From the viewpoint of the ease of forming a continuous coating, the aforesaid resin for formation of the interlayer should desirably have a melt index measured by ASTM D1238-57T of at least about 0.1 g/10 min., preferably at least about 0.5 g/10 min.

So long as the film-forming resin can level the uneven surface of the paper substrate and form a continuous coating thereon, it should be applied in as thin a layer as possible so that the inherent properties of the paper substrate, such as bursting property, bendability (flexibility), strength, elongation and hardness, can be substantially retained. The thickness of the continuous layer of the resin differs depending upon the type of the film-forming resin used. Generally, the suitable thickness of the resin coating on the paper substrate is about 1 to about 30 microns, preferably about 2 to about 20 microns.

Accordingly, the film-forming resin may be applied to the paper substrate by any known method which can give a very thin continuous coating. For example, depending upon the type of the resin used, melt-coating or solution coating is possible. With the melt coating method, it is difficult to form a thin smooth continuous coating. With the solution coating method, the resin may be absorbed by the paper and therefore the inherent properties of the paper tend to change. It has been found in accordance with this invention that a very thin continuous coating of the resin can be formed very easily by coating an aqueous dispersion of the film-forming resin on the paper substrate, and therefore, this method is most convenient in this invention.

The aqueous dispersion of the film-forming resin can be prepared in a manner known per se. For example, it may be prepared by forming an aqueous dispersion of the film-forming resin by emulsion polymerization or suspension polymerization; or by re-dispersing a film-forming resin, prepared separately, in an aqueous medium. The concentration of the resin in the aqueous disoersion is not critical, and can be varied according to the type of the resin used, etc. To provide a suitable viscosity for coating, the solid concentration of the aqueous dispersion is advantageously about 10 to about 60% by weight, preferably about 20 to about 50% by weight, based on the weight of the aqueous dispersion. Desirably, the resin dispersed in the aqueous dispersion is in the form of particles having the finest possible particle diameter. From the standpoint of the viscosity of the aqueous dispersion, the smoothness of the resulting coating, etc., it is desirable that the particles of the resin should have an average particle diameter of about 0.005 to about 20 microns, preferably about 0.01 to about 15 microns.

If emulsifiers, surface-active agents and other additives used in performing emulsion polymerization or suspension polymerization to prepare such an aqueous dispersion are volatile, they may evaporate when a paper substrate coated with the aqueous dispersion is placed under vacuum for vacuum deposition. As a result, it is difficult to produce a high vacuum or a long period of time is required for producing a high vacuum. Accordingly, when such additives are used, their amounts should be made as small as possible, for example, should be adjusted to not more than about 5% by weight based on the weight of the film forming resin in an aqueous dispersion. Or it is recommended to use high-molecular-weight emulsifiers or surface-active agents having low volatility.

In this regard, the carboxy-modified olefinic resin, particularly the ionomer resin and $\alpha,\beta$-ethylenically unsaturated carboxylic acid-grafted polyolefin, is an especially preferred resin for use in this invention because it is self-dispersible, can be re-dispersed in fine particles in an aqueous medium, and has excellent adhesion to metals.

The ionomer resin used in this invention is a thermoplastic resin obtained by copolymerizing the olefin and the $\alpha,\beta$-ethylenically unsaturated carboxylic acid, and neutralizing some or all of carboxyl groups in the resulting carboxyl-containing polyolefin with a metal such as sodium, potassium, magnesium or zinc to ionize them. This resin has the property of easily self-dispersing in water without the use of a surface-active agent, to give an aqueous dispersion. The aqueous dispersion of the ionomer resin is used alone or as a mixed aqueous dispersion with a polyolefinic resin inherently having no self-dispersibility prepared by simply mixing it uniformly with a compatible resin having or not having a polar group, such as an ethylene/vinyl acetate copolymer or polyethylene.

On the other hand, an aqueous dispersion of the $\alpha,\beta$-ethylenically unsaturated carboxylic acid-grafted polyolefin can be easily prepared by adding its melt to stirred hot water containing a basic substance (for details of the method for its preparation, see British Patent Specification No. 1517828). If at this time, a mixture of such a graft polyolefin with ethylene/vinyl acetate copolymer, polyethylene, etc., is treated in the same way, an aqueous dispersion of the graft polyolefin and such a non-selfdispersible polyolefinic resin can be formed. Specifically, such a mixed aqueous dispersion can be easily formed by mixing 50 to 1 part by weight of an $\alpha,\beta$-ethylenically unsaturated carboxylic acid-grafted polyolefin having an acid value of about 30 to 150, preferably 50 to 130, with 50 to 99 parts by weight of a compatible non-selfdispersible polyolefinic resin such as ethylene/vinyl acetate copolymer or polyethylene, melting the mixture, and adding the uniform molten mixture to stirred hot water containing a basic compound. Accordingly, the aforesaid mixed aqueous dispersion of the grafted polyolefin and the non-selfdispersible polyolefinic resin can also be used as the aqueous dispersion of the self-dispersible polyolefinic resin as can the aforesaid mixed aqueous dispersion of the ionomer.

The non-selfdispersible polyolefin resin that can be used in combination with the ionomer or the grafted polyolefin includes homopolymers or copolymers of alpha-olefins such as ethylene, propylene, 1-butene or 4-methyl-1-pentene. Specific examples are homopolymers such as polyethylene, polypropylene, poly-1-butene and poly-4-methyl-1-pentene and resinous or rubbery copolymers such as ethylene/propylene copolymer, ethylene/1-butene copolymer, ethylene/-butadiene copolymer, ethylene/propylene/butadiene terpolymer, ethylene/propylene/dicyclopentadiene terpolymer, ethylene/propylene/ethylidenenorbornene terpolymer, propylene/1-butene copolymer, propylene/butadiene copolymer, ethylene/vinyl acetate and a saponification product of ethylene/vinyl acetate copolymer. These resins can be used either singly or in combination with each other.

When the aqueous dispersion of the self-dispersible polyolefinic resin has a solids concentration of generally about 10 to about 60% by weight, preferably about 20 to about 50% by weight, it has a viscosity suitable for coating, and formation of pinholes in a coated film from the aqueous dispersion can be prevented. If desired, it is possible to minimize penetration of the aqueous dispersion into paper by adjusting its viscosity with a thickener.

The aqueous dispersion prepared in the above manner can be coated on the paper substrate in a customary manner, for example by spray coating, roller coating, gravure coating, flow coating, bar coating, etc. Usually, one coating results in a metal-deposited surface of poor luster and also tends to provide a product having poor moisture-proofness, unless the surface of the substrate is smooth. Accordingly, it is usually desirable to perform the coating two or more times until the desired smoothness of the coated surface is obtained. For example, when it is desired to apply a resin coating at a rate of 6 to 8 $g/m^2$ on the paper substrate, better results are obtained by coating the aqueous dispersion 3 or 4 times providing a resin coating of about 2 $g/m^2$ each time than by coating all the aqueous dispersion at a time.

The total amount of the aqueous dispersion coated is not critical, and can be varied according to the type of the resin used, etc. Generally, it is advantageous to adjust the total amount to about 1 to about 30 $g/m^2$, preferably about 2 to about 20 $g/m^2$, as the amount of the resin coated.

When the coating of the aqueous dispersion is repeated two or more times, it is often noted that the aqueous dispersion coated on the previously formed resin coating is repelled to cause difficulty of giving a uniform coating thereon, and vacuum deposition of a metal on the resulting non-uniform coating results in a metal layer having no inherent metallic luster which varies in color and sometimes becomes whitened. This phenomenon is liable to occur when an aqueous dispersion containing the self-dispersible carboxy-modified polyolefinic resin and being free from a surface active agent is coated two or more times. This phenomenon may be prevented by incorporating into the aqueous dispersion at least after one coating cycle a wetting agent for improving wetting of the coating surface, for example a nonionic surface-active agent such as polyoxyethylene lauryl ether, polyoxyethylene sec-butyl ether, polyoxyethylene-polyoxypropylene block copolymer, and polyoxyethylene nonylphenol. However, since such a surface-active agent is generally of low molecular weight and is liable to volatilize during an evacuating operation for metal deposition making it difficult to provide a high vacuum, the amount of such a wetting agent should be minimized. Preferably, its amount should be limited to not more than 5% by weight, preferably not more than 3% by weight, based on the resin in the aqueous dispersion.

The present inventors have now found that such a difficulty can be overcome by adding polyvinyl alcohol to the aqueous solution. Polyvinyl alcohol suitable for this purpose is obtained by saponifiying polyvinyl acetate to a saponification degree of at least 751%, preferably at least 80%, and has a viscosity, as a 4% aqueous solution, of at least 3 centipoises (at 20° C.), preferably 5 to 50 centipoises (at 20° C.). Desirably, the polyvinyl alcohol does not substantially contain impurities or volatile components. If desired, the polyvinyl alcohol can also be used in the form of random copolymer with an $\alpha,\beta$-unsaturated carboxylic acid such as acrylic acid or maleic anhydride or its derivative or with ethylene as a comonomer.

The amount of the polyvinyl alcohol is generally up to about 15% by weight, preferably about 0.03 to about 10% by weight, more preferably 0.1 to 5% by weight, based on the weight of the resin in the aqueous dispersion.

The coated aqueous dispersion is then dried. Drying can be performed at room temperature, but advantageously, at a temperature corresponding to the softening point of the coated resin or higher but below a temperature at which the paper substrate or the resin coating is thermally degraded, usually at a temperature lower than about 200° C. The drying conditions depend also upon the particle diameter of the resin particles in the aqueous dispersion. Generally, drying is preferably carried out at a relatively high temperature when the particle diameter is large, and at a relatively low temperature when the particle diameter is small. Generally, the drying may be carried out at a temperature of at least 100° C. for several seconds to several minutes. When the coating is carried out to two or more times, the drying may be carried out every time the coating is over. Or the drying may be performed at a low temperature after the first and subsequent coatings, and at a high temperature above the softening point of the resin after the final coating. In this manner, a continuous coating of the resin having a thickness of generally about 1 to about 30 microns, preferably about 2 to about 20 microns, can be formed on the paper substrate.

A metal is then vacuum-deposited on the resin coating formed on the paper substrate. The term "metal", as used in the present application, also denotes alloys. This vacuum deposition can be effected in a manner known per se. For example, it can be carried out by heating a metal to be deposited to a temperature above its melting point in a high vacuum of for example $10^{-3}$ to $10^{-5}$ mmHg. Examples of the metal to be deposited include aluminum, tin, zinc, lead, copper, silver, gold, manganese, magnesium, brass, nickel, chromium, Ni-Cr alloy, and Ni-Fe alloy. The thickness of the metal deposited film is not critical, and can be varied according to the utility of the final product. Generally, the thickness is about 100 to about 1000 Å, preferably about 300 to about 700 Å.

The adhesion of the resulting metal deposited film to the paper substrate through the resin coating is good, and shows a satisfactory result in an ordinary adhesive tape peel test.

The metal-deposited paper provided by this invention has a superior metallic luster and a decorative appearance, and has a low gas- and moisture-permeability. It can be used widely, for example, in packaging foodstuffs, tobaccos, medicines, etc. and also as labels, silver or gold yarns, and paper condensers.

Depending upon end uses, it is possible to emboss the metal-deposited surface, or to impart a transparent or semitransparent color, or to form a protective layer for preventing discoloration.

The following Examples illustrate the present invention more specifically.

EXAMPLES 1 TO 16

Each of the aqueous dispersions of resin A to F described below has roller-coated on one surface of a sheet of wood free paper (basis weight 64 g/m$^2$) in the amounts shown in Table A through the number of times shown in Table A to obtain paper having a resin coating with a thickness of about 2 to about 12 microns. Drying was performed at 120° C. for 5 seconds each time about 2 to about 12 microns.

In a vacuum-deposition device kept at $10^{-4}$ mmHg, aluminum (purity 99.99%) was deposited on the surface of the resin coating of the resulting paper by a boat-type resistance heating method to form an aluminum-deposited film having a thickness of about 500 Å on the surface of the resin coating.

The aqueous dispersions used to form the resin coating on the wood-free paper had the following compositions.

Aqueous dispersion A

An aqueous dispersion having a solids concentration of 35% by weight and prepared by mechanically dispersing a molten mixture of 90 parts by weight of polyethylene (density 0.92 g/cm$^3$, melt index 23 g/10 minutes) and acrylic acid-grafted polyethylene (acid value 100, intrinsic viscosity measured on a decalin solution 0.8, melting point 124° C.) in an average particle diameter of about 10 microns in water having dissolved therein potassium hydroxide.

Aqueous dispersion B

An aqueous dispersion having a solids concentration of 27% by weight and a viscosity of 500 centipoises at 25° C., and prepared by mechanically dispersing an ionomer resin (a sodium salt of an ethylene/methacrylic acid copolymer having a methacrylic acid unit content of 15% by weight, a neutralization degree of 59 mole%, a density of 0.95 g/cm$^3$, melting point of 87° C., and a melt index of 0.9 g/10 min. at 190° C. by ASTM D1238-57T) in an average particle diameter of about 0.1 micron in water.

Aqueous dispersion C

A commercially available emulsion of a vinylidene chloride-type polymer (vinylidene chloride/-butadiene/methyl acrylate copolymer, a product of Kureha Chemical Industry Co., Ltd.) having a solids concentration of 50% by weight.

Aqueous dispersion D

A commercially available emulsion of an acrylic polymer (styrene/butyl acrylate/butyl methacrylate copolymer) having a solids concentration of 42.5% by weight.

Aqueous dispersion E

A commercially available styrene/butadiene copolymer rubber latex (a product of Nippon Zeon Co., Ltd.) having a solids concentration of 50% by weight.

Aqueous dispersion F

A commercially available nitrile-butadiene copolymer rubber latex (a product of Nippon Zeon Co., Ltd.) having a solids concentration of 50% by weight.

When the aqueous dispersion A or B was coated two or more times, polyoxyethylene lauryl ether was added to the aqueous dispersions A or B coated in the second and subsequent coating cycles. The amount of polyoxyethylene lauryl ether was 0.2% based on the weight of the dispersion for the aqueous dispersion A, and 0.05% by weight based on the weight of the dispersion for the aqueous dispersion B.

The properties of the resulting aluminum-deposited papers were measured by the following methods.

(i) Peel resistance

An adhesive cellophane tape was applied to the surface of the aluminum-deposited layer, and then peeled off to examine the adhesion of the deposited layer.

(ii) Moisture permeability

Measured in accordance with ASTM D-1434-58 at a temperature of 40° C. and a relative humidity of 90% (unit; g/m$^2$ 24 hrs).

(iii) Degree of gloss

Measured at a light projecting angle of 45° and a light receiving angle of 45° using an automatic angle variable glossmeter VG-107 (an instrument made by Nippon Denshoku Kogyo K.K.) in accordance with ASTM D1223-57T.

The results are shown in Table A.

The aluminum-deposited papers substantially retained the strength, elongation, and hardness of the wood-free paper used as a substrate.

TABLE A

| | Aqueous dispersion | | | Properties of the aluminum-deposited paper | | |
|---|---|---|---|---|---|---|
| Example | Type | Total amount coated (solids content, g/m$^2$) | Number of coating cycles | Peel resistance | Moisture permeability (g/m$^2$. 24 hrs.) | Degree of gloss |
| 1 | A | 4 | 1 | Good | 4000 | 50 |
| 2 | " | 8 | " | " | 2500 | 60 |
| 3 | " | 12 | " | " | 1000 | 90 |
| 4 | " | 8 | 2 | " | 40 | 150 |
| 5 | " | " | 4 | " | — | 160 |
| 6 | B | 2 | 1 | " | 3500 | 50 |
| 7 | " | 4 | " | " | 2000 | 140 |
| 8 | " | 8 | " | " | 300 | 180 |
| 9 | " | 4 | 2 | " | 5 | 200 |
| 10 | " | 8 | " | " | 4 | 350 |
| 11 | " | " | 4 | " | 2 | 600 |
| 12 | C | 6 | 1 | " | 100 | 100 |
| 13 | " | 10 | 2 | " | 8 | 200 |
| 14 | D | 6 | " | " | — | 50 |
| 15 | E | " | 3 | " | 300 | 300 |
| 16 | F | " | " | " | 200 | 140 |
| Untreated wood-free paper | | | | — | 5500 | — |
| Aluminum foil (10 microns thick) | | | | — | 1 | 520 (bright surface) 140 (back |

TABLE A-continued

| Example | Aqueous dispersion: Type | Total amount coated (solids content, g/m²) | Number of coating cycles | Properties of the aluminum-deposited paper: Peel resistance | Moisture permeability (g/m². 24 hrs.) | Degree of gloss |
|---|---|---|---|---|---|---|
| | | | | | | surface) |

TABLE B-continued

| Example | Composition of the coated film (wt. %): Ionomer | Polyvinyl alcohol | Properties of the aluminum-deposited paper: Peel resistance | Moisture permeability (g/m²) | Degree of gloss |
|---|---|---|---|---|---|
| 21 | 95 | 5 | " | " | 300 |
| 22 | 90 | 10 | " | 7 | 270 |
| 23 | 85 | 15 | " | 10 | 180 |

EXAMPLES 17 TO 23

An ionomer resin (a sodium salt of an ethylene/methacrylic acid copolymer having a methacrylic acid unit content of 15% by weight, a density of 0.95 g/cm³ and a neutralization degree of 59 mole%) was mechanically dispersed in water to prepare an aqueous dispersion having a solids concentration of 20% and containing resin particles with an average particle diameter of about 0.1 micron. Separately, polyvinyl alcohol (#H, a product of Kuraray Co. Ltd.; degree of polymerization 1700, degree of saponification about 99.9%, viscosity as a 4% aqueous solution about 30 cps) was dissolved in water to form a 10% solution, and added in the proportions shown in Table B to the aqueous dispersion of the ionomer resin prepared as above.

The resulting mixed aqueous dispersion was coated three times on one surface of wood-free paper (basis weight 54 g/m²) by a roll coater at a rate of 2 g/m² in each coating cycle. The drying of the coating was performed at 120° C. for 5 seconds each time to obtain wood-free paper having a resin-coated layer with a thickness of about 6 microns.

Aluminum was vacuum-deposited on the coated wood-free paper in the same way as in Examples 1 to 16 in a vacuum deposition device kept at $10^{-4}$ mmHg to form an aluminum-deposited film having a thickness of about 500 Å on the resin coated surface of the paper. The peel resistance, moisture permeability and degree of gloss of the resulting paper were measured in the same way as in Examples 1 to 16. The results are shown in Table B.

TABLE B

| Example | Composition of the coated film (wt. %): Ionomer | Polyvinyl alcohol | Properties of the aluminum-deposited paper: Peel resistance | Moisture permeability (g/m²) | Degree of gloss |
|---|---|---|---|---|---|
| 17 | 99.97 | 0.003 | Good | 5 | 300–400 |
| 18 | 99.95 | 0.05 | " | " | 400 |
| 19 | 99.9 | 0.1 | " | " | 400 |
| 20 | 99 | 1 | " | " | 390 |

In Example 17, the degree of gloss ranged. This suggests variations in the degree of gloss, and perhaps some "repelling phenomenon" occurred during overcoating. In the other Examples the repelling phenomenon did not occur. In Example 23, the aluminum-deposited layer became somewhat whitened.

EXAMPLES 24 TO 32

A 5% aqueous solution of commercially available polyvinyl alcohol (C-15, product of Shinetsu Chemical Co., Ltd.; saponification degree 98.5%, viscosity as 4% aqueous solution 22 centipoises) was coated by one operation on one surface of commercially available Simili; (basis weight about 52 g/m²) in an amount of 0.4 g/m² as solids, and dried for 10 seconds by blowing hot air at 120° C. against the coated surface. A aqueous dispersion of each of the ionomer resins (a partial Na salt of an ethylene/methacrylic acid copolymer) shown in Table C below was coated on the other surface. Aluminum was then vacuum-deposited on the resin coating to form an aluminum layer having a thickness of 400 Å.

The properties of the aqueous dispersions used are also shown in Table C.

TABLE C

| Designation of the aqueous dispersion | Properties of the ionomer resin: Methacrylic acid unit content (wt. %) | Degree of neutralization (mole %) | Melting point (°C.) | Properties of the aqueous dispersion: Particle size (microns) | Viscosity (centipoises) | Concentration (wt. %) |
|---|---|---|---|---|---|---|
| I | 10 | 25 | 96 | 7 | 125 | 48 |
| J | 12 | 48 | 90 | 0.25 | 506 | 39 |
| K | 13 | 17 | 88 | 0.38 | 1660 | 30 |
| L | 14 | 42 | — | 0.24 | 226 | 39 |
| M | 15 | 59 | 87 | 0.05 | 1000 | 27 |

The coating conditions and the properties of the metal-deposited papers are shown in Table D.

TABLE D

| Example | Aqueous dispersion: Type | Coating conditions: Total amount coated (g/m²) | Number of coating cycles | Properties of the metal-deposited paper: Moisture permeability (g/m²) | Degree of gloss |
|---|---|---|---|---|---|
| 24 | I | 12 | 3 | 1.2 | 350 |
| 25 | J | " | " | 0.9 | 440 |
| 26 | K | " | " | 1.1 | 730 |
| 27 | L | " | " | 1.0 | 520 |
| 28 | M | " | " | 0.7 | 860 |
| 29 | " | 2 | 1 | 3500 | 200 |
| 30 | " | 4 | 2 | 5 | 340 |
| 31 | " | 6 | 3 | 2.1 | 620 |
| 32 | " | 8 | 4 | 0.9 | 850 |

EXAMPLE 33

The same polyvinyl alcohol as used in Examples 24 to 32 was coated at a rate of 0.4 g/m$^2$ on one surface of commercially available Simili (a product of Kasuga Paper-Making Co., Ltd.; basis weight 52 g/m$^2$, width 700 mm) in the same way as in Example 24 to provide a coating of polyvinyl alcohol having a thickness of about 0.4 micron after drying. A sodium salt of an ethylene/methacrylic acid copolymer was coated on the other surface of the paper at a rate of 7 g/m$^2$ in the same way as in Example 24 to form a resin coating having a thickness of about 7 microns. Aluminum was vacuum-deposited on the resin coating to form an aluminum layer having a thickness of 400 Å. Thus, an aluminum-deposited paper having a length of 2000 meters was produced and wound up. The paper roll was allowed to stand for 3 days in an atmosphere kept at 40° C. Samples were taken from the paper roll at positions about $\frac{1}{3}$, about $\frac{1}{2}$ and about $\frac{2}{3}$ of the roll diameter from the periphery of the roll. The wetting tensions of these samples were measured, and found to be 52 dynes/cm, 54 dynes/cm, and 50 dynes/cm, respectively.

EXAMPLES 34 TO 43

A highly fibrillated fibrous material of high-density polyethylene (density 0.96 g/cm$^3$, melting point 130° C., average fiber length 1.6 mm) was provided as a synthetic pulp, and paper-making bleached kraft pulp was provided as a natural pulp. The synthetic pulp and the natural pulp were mixed in the proportions shown in Table E and formed into a sheet by a wet method.

An aqueous dispersion (particle diameter about 0.1 microns, solids concentration about 25% by weight) of a sodium salt of an ethylene/methacrylic acid copolymer (methacrylic acid unit content 15% by weight, neutralization degree 59%, density 0.95 g/cm$^3$) containing about 0.05% by weight of the same polyvinyl alcohol as used in Examples 17 to 23 was coated on one surface of the resulting paper two or four times at a rate of about 2 g/cm$^2$ as solids in each coating cycle, and dried at 110° C. for 20 seconds each time to form a resin coating having a thickness of about 4 to about 8 microns.

Aluminum was vacuum-deposited on the resulting paper having the resin coating in a high vacuum device kept at $10^{-3}$ to $10^{-5}$ mmHg to form an aluminum layer having a thickness of about 500 Å on the resin coating.

The degree of gloss and moisture permeability of each aluminum-deposited paper were measured in the same way as in Example 1 to 16. The results are shown in Table E.

The aluminum-deposited paper obtained in Example 41 was punched out in an elliptical shape, and heat-molded at a mold temperature of 200° C. with a cycle time of 2 seconds using a deep draw molding machine (a product of Joh. Gietz + Co.; GIETZ automatic paper plate shaping machines). A good quality dish having a faithfully reproduced uneven profile could be obtained with good efficiency.

TABLE E

| Example | Mixing proportions of pulps (wt. %) | | Basis weight of paper substrate (g/m$^2$) | Number of coating cycles | Properties of the aluminum-deposited paper | |
|---|---|---|---|---|---|---|
| | Synthetic pulp | Natural pulp | | | Degree of gloss | Moisture permeability (g/m$^2$ 24 hrs) |
| 34 | 100 | 0 | 65 | 2 | 180 | 2 |
| 35 | 60 | 40 | 75 | " | 170 | 5 |
| 36 | 50 | 50 | 70 | " | 200 | 10 |
| 37 | 25 | 75 | 37 | " | 150 | 23 |
| 38 | 100 | 0 | 65 | 4 | 580 | 1 |
| 39 | 60 | 40 | 75 | " | 450 | <1 |
| 40 | 50 | 50 | 70 | " | 510 | <1 |
| 41 | 25 | 75 | 37 | " | 400 | <1 |
| 42 | 10 | 90 | 270 | " | 850 | 1 |
| 43 | 8 | 92 | 260 | " | 630 | <1 |

What we claim is:

1. A metal-deposited paper comprising a paper substrate, a thin continuous coating of an alkali metal ion cross-linked product of an ethylene/methacrylic acid copolymer, an ionomer resin, on at least one surface thereof, and an aluminum film vacuum-deposited on the resin coating to a thickness of about 100 to about 1000 A, said continuous resin coating having been formed by coating an aqueous dispersion of the ionomer resin in at least two coating cycles on the surface of the paper substrate so that the amount of solids coated is about 1 to about 30 g/m$^2$.

2. The paper of claim 1 wherein said ionomer resin is an ethylene/methacrylic acid copolymer having 5 to 45% by weight of methacrylic acid units, 30 to 80% of which are neutralized with an alkali metal ion.

3. The paper of claim 1 wherein said ionomer resin contains at most 15% by weight, based on the weight of the resin, of polyvinyl alcohol.

4. The paper of claim 1 wherein said continuous resin coating has a thickness of about 1 to about 30 microns.

5. The paper of claim 1 wherein said continuous resin coating has been formed by coating the aqueous dispersion of the ionomer resin on the paper substrate so that the amount of solids coated is about 2 to about 20 g/m$^2$.

6. The paper of claim 1 wherein said aqueous dispersion has a solids concentration of about 10 to about 60% by weight.

7. A metal-deposited paper having a high gloss metallic luster and low air- and moisture-permeability and substantially retaining the inherent mechanical properties of paper including bursting property, bendability, strength, elongation and hardness, said paper comprising a paper substrate, a thin continuous coating of an alkali metal ion cross-linked product of an ethylene/methacrylic acid copolymer, an ionomer resin, having a thickness of from about 2 to about 20 microns on at least one surface of the paper substrate, and an aluminum film having a thickness of from about 300 to about 700 angstroms vacuum-deposited on the resin coating, said continuous ionomer resin coating having been formed by coating in at least two coating cycles an aqueous dispersion of the ionomer resin on the surface of the paper substrate so that the amount of solids coated is from about 2 to about 20 $g/m^2$.

8. The metal-deposited paper of claim 7 wherein said aqueous dispersion of the ionomer resin further includes from about 0.03 to about 10% by weight of polyvinyl alcohol, based on the weight of the ionomer resin.

* * * * *